US005688001A

United States Patent [19]

Klein et al.

[11] Patent Number: 5,688,001

[45] Date of Patent: Nov. 18, 1997

[54] LOCKING MECHANISM, IN PARTICULAR FOR SUITCASES OR THE LIKE

[75] Inventors: Helmut Klein, Velbert; Wolfgang Buss, Solingen, both of Germany

[73] Assignee: Franzen International, Inc., Franklin Lakes, N.J.

[21] Appl. No.: 451,053

[22] Filed: May 25, 1995

[30] Foreign Application Priority Data

May 27, 1994 [DE] Germany ..... 9408707 U

[51] Int. Cl.[6] ..... E05C 5/00

[52] U.S. Cl. ..... 292/67; 292/DIG. 49; 292/63

[58] Field of Search ..... 292/67, 63, 64, 292/66, 71, 109, 110, 114, DIG. 31, DIG. 49, DIG. 71, 58

[56] References Cited

U.S. PATENT DOCUMENTS

| | | | |
|---|---|---|---|
| 2,893,088 | 7/1959 | Harper et al. | 24/638 |
| 3,409,320 | 11/1968 | Eckerle | 292/113 |
| 3,706,467 | 12/1972 | Martin | 292/DIG. 49 |
| 3,831,580 | 8/1974 | McLean | 126/197 |
| 3,847,423 | 11/1974 | Gley | 292/DIG. 49 |
| 4,159,137 | 6/1979 | Richter | 292/DIG. 49 |
| 4,163,443 | 8/1979 | Peterson | 126/197 |
| 4,588,219 | 5/1986 | Kobayashi | 292/336.3 |
| 4,858,970 | 8/1989 | Tedesco et al. | 292/113 |
| 5,058,939 | 10/1991 | Miilu | 292/110 |

FOREIGN PATENT DOCUMENTS 40 35 859 5/1992 Germany .

*Primary Examiner*—Steven N. Meyers
*Assistant Examiner*—Gary Estremsky
*Attorney, Agent, or Firm*—Shapiro and Shapiro

[57] ABSTRACT

A locking mechanism comprises a housing, a shaft extending in the housing and having a latch member thereon adjacent to one end thereof, and an actuating lever adjacent to an opposite end of a shaft. The shaft, actuating lever, and housing are interconnected in a manner that causes the shaft to move longitudinally in response to turning of the actuating lever to a predetermined extent from a rest position, so that the latch member moves from a first position to a second position, and for causing the shaft to tilt in response to continued turning of the actuating lever, so that the latch member is turned away from the second position.

8 Claims, 6 Drawing Sheets

LOCKING MECHANISM, IN PARTICULAR FOR SUITCASES OR THE LIKE

BACKGROUND OF THE INVENTION

The invention concerns a locking mechanism, in particular for suitcases or the like, with a pivoting actuating lever and a curve-controlled pivoting as well as a longitudinally shifting tension hook.

A locking mechanism of the type in question is known from DE 4035859 A 1, with the actuating lever displaced around a pivot axis located in the housing for the locking mechanism. The single-arm actuating lever forms a hook with a latch surface on the one end which in turn cooperates with a linear moving latch bolt. The pivoting displacement of the actuating lever is transmitted onto the curve-controlled tension hook via a connecting rod. During the locking motion the slope of the latch exerts a force on the latch bolt, together with an increase of friction resulting from it. After its evading motion the hook will engage in the lock bolt from behind. The tension hook furthermore pivots during this motion and is shifted longitudinally, thus creating the attractive force acting on the counterlocking component. Opening of the locking mechanism requires the exertion of force onto a trip latch which in turn acts on the latch bolt via a chain link.

BRIEF DESCRIPTION OF THE INVENTION

The task of the matter of the invention is to provide for a locking mechanism of the type in question which allows for a simple manufacturing and at the same time offers an advantageous utilization.

This requirement is met for a lock of the kind in question due to the fact that the pivot point of the actuating lever also acts as the coupling point between tension hook and actuating lever and may be displaced in the direction of the linear shifting and since an arm of the actuating lever that extends beyond the pivot point moves in a control curve which in turn is responsible for the linear shifting.

As a result of this particular design a locking mechanism of the kind in question is created which, on the one hand, is characterized by a simple design and, on the other, by a high practical value. The actuating lever and the tension hook are the only components of the locking mechanism, apart from the gudgeons which move in slotted guides. The tension hook and the actuating lever are directly coupled to one another so that they are allowed to pivot. The corresponding pivot point is guided linearly in the housing of the locking mechanism. The actuating lever may be shifted longitudinally and pivot around this specific coupling point which at the same time acts as the pivot point. While the actuating lever pivots, the pivot point in turn is shifted longitudinally, with the arm of the actuating lever that extends beyond the pivot point being displaced in the control curve, thus forcing a linear shifting of the pivot point combined with a simultaneous longitudinal shifting of the tension hook, which reaches the release position with respect to the counterlocking component. When the actuating lever is in its open position and pivots to the locked position, this in turn will cause a motion of the pivot point in opposite direction, with the tension hook exerting an attractive force in the locking direction. The displacement of the pivot point, which at the same time acts as a coupling point between tension hook and actuating lever, in the opposite direction results from the return motion of the arm of the actuating lever that extends beyond the pivot point in the control curve of the housing of the locking mechanism.

Another advantageous characteristic is the fact that the gudgeon of the actuating lever which moves in the control curve, moves beyond the dead center line between the open and tension position, with the line extending through the pivot point of the actuating lever and the claw of the tension hook. This measure proves to be significant, in particular in the locked position, i.e. in the tension position, since the forces exerted on the tension hook in the opening direction increasingly tend to pivot the actuating lever towards the locked position. Opening of the locking mechanism must therefore be an intentional effort, during which opening displacement of the actuating lever the gudgeon at the end of the lever will move beyond the aforementioned dead center line. The attractive forces acting on the tension hook will then support the pivoting motion of the actuating lever in the opening direction, again secured by the gudgeon moving beyond the dead center line.

Another advantageous characteristic is the existence of a draw spring which secures both positions beyond the dead center line. As soon as the gudgeon at the end of the actuating lever moves beyond the dead center line, the draw spring either acts in the opening or in the tension direction, ensuring that the defined end positions are reached. Furthermore the spring prevents, e.g. the actuating lever from leaving the tension position, where it is maintained by no other means, even if the locking mechanism is subject to strong vibrations.

The fact that an angled slot is provided for between the control curve and the claw of the tension hook in which a shaft of the tension hook is guided is also worth mentioning. If the shaft moves in the one section of the angled slot, then only a linear displacement of the tension hook occurs. As soon as the shaft enters the other section of the angled slot, located at an angle to the first section, it will inevitably cause a pivoting of the tension hook which in turn causes the claw of the tension hook to release the counterlocking component.

According to the invention it is furthermore advantageous that the end of the tension hook opposite to its claw is designed as a filling piece which penetrates into an aperture of the actuating lever until it is flush with its surface. This filling piece has a dual function. On the one hand it acts as a coupling section between actuating lever and tension hook. On the other hand the filling piece closes the aperture in the actuating lever when in the tension position. The visual appearance of the locking mechanism is improved and access to the inside of the locking mechanism is also prevented due to the filling piece's surface being flush with the outside of the locking mechanism.

If the locking mechanism is installed in a suitcase it will be favorable if the shaft of the tension hook is equipped with a collar. This collar, when in the tension position, will close off the bore for the claw of the tension hook.

With this design it is advantageous that the collar exerts pressure on a seal which surrounds the shaft hole while at the same time closing it. This in turn ensures that no access to the inside of the suitcase is possible from the locking mechanism side due to the collar of the shaft resting against the seal.

BRIEF DESCRIPTION OF THE DRAWINGS

The following is an example for one version of the invention, explained on the basis of the drawings. The example shows.

DETAILED DESCRIPTION OF THE INVENTION

Figure 1:
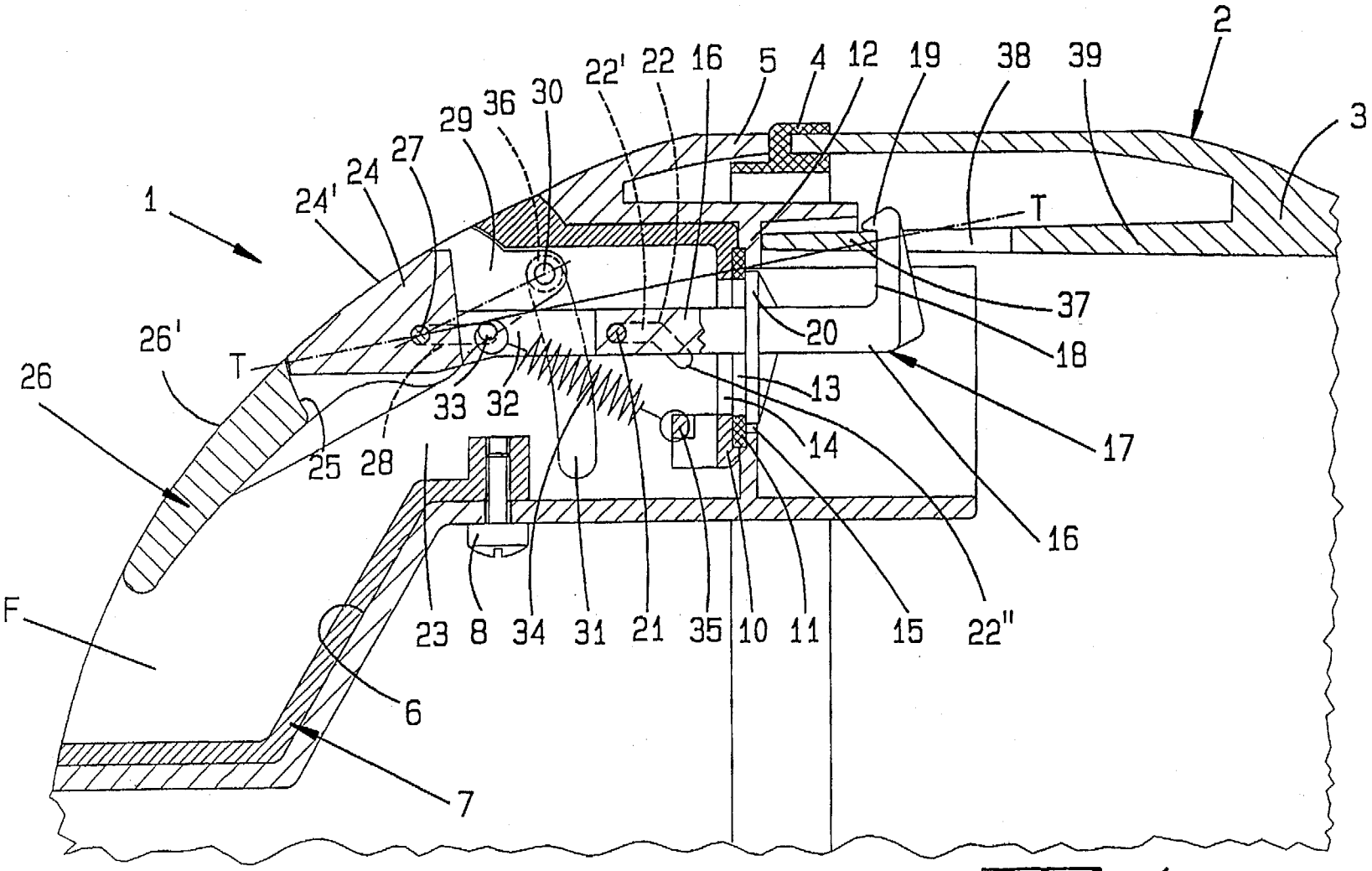
FIG. 1 a partial cross section of a suitcase on the level of the locking mechanism in its tension position, FIG. 2 partially a cross section, partially a top view of the suitcase in the area of the locking mechanism, FIG. 3 a representation that corresponds to FIG. 1, the actuating lever pivoted in opening direction to where the gudgeon on the actuating lever end is on the level of the dead center line, FIG. 4 the representation following FIG. 3, with the tension hook, other than in FIG. 3, having carried out a linear shift in the opening direction, FIG. 5 the opening position of the locking mechanism with the tension hook in its fully released position and FIG. 6 a perspective view of the various components of the locking mechanism.
Figure 2:
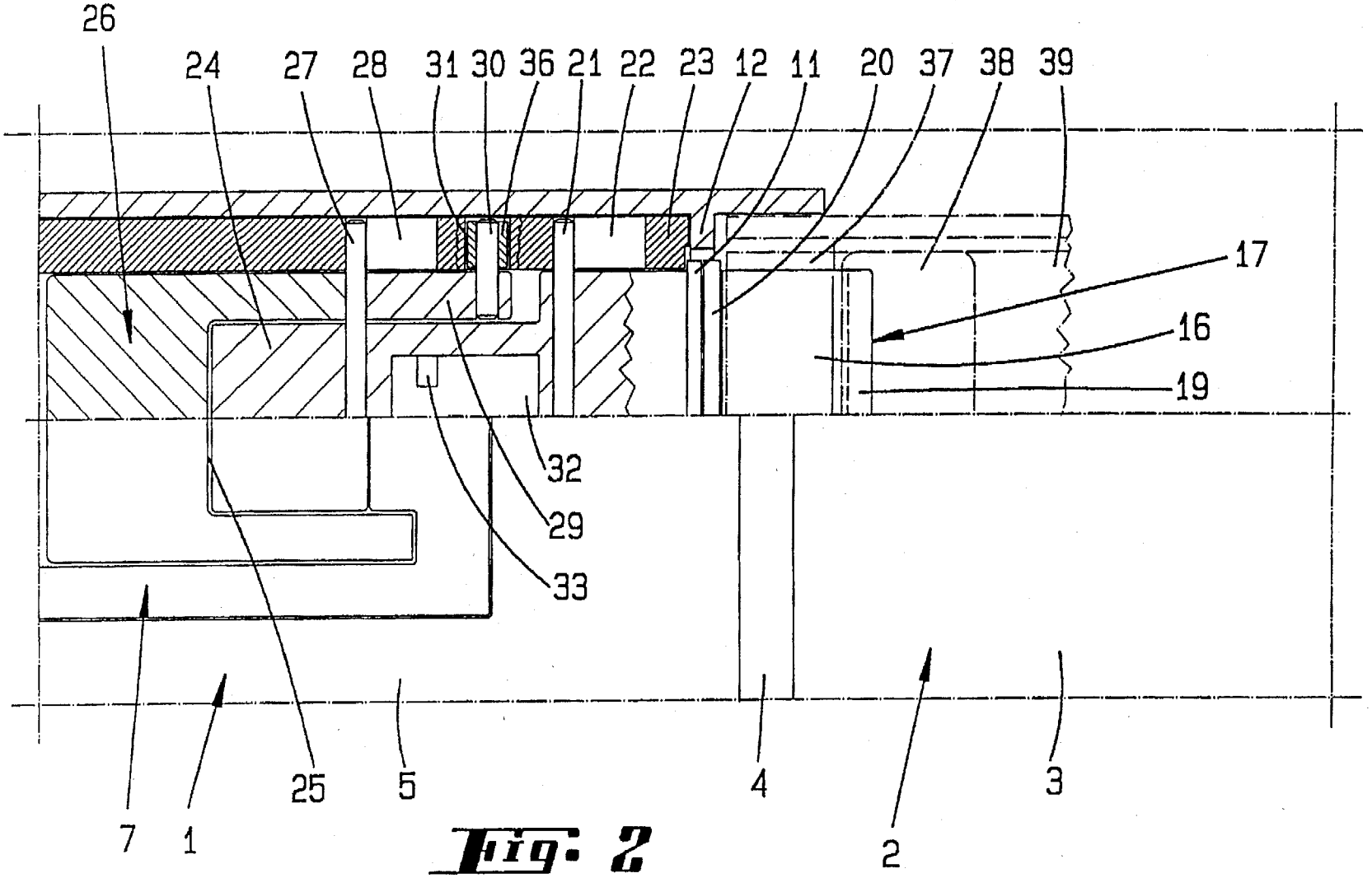

The lock marked as a whole with the FIG. (1) is allocated to a suitcase (2), a partial view of which is given. This suitcase (2) features a shell-type bottom section (3) with a seal (4) mounted on the edge of the shell and a shell-type cover lid (5). The bottom section (3) and the cover lid (5) are connected to one another on the side (not shown) opposite to the locking mechanism (1) in a well-known manner by means of hinges.

The locking mechanism (1) is equipped with a housing (7) installed in a recess (6) of the cover lid (5). The mounting position of the housing (7) is secured by a screw (8), screwed in from the inside of the suitcase, the threaded section of the screw engaging in a threaded bore (9) of the housing (7) of the locking mechanism. A front wall (10) of the locking mechanism housing is supported by an intermediate panel (12) of the suitcase cover lid (5), with a seal (11) placed between the front wall (10) and the intermediate panel (12), the latter limiting the size of the recess (6). The seal (11) is designed as a square frame, so that its opening (13) aligns with a shaft hole (14) in the front wall (10). An opening (15) in the intermediate panel (12) is located on the other side, adjacent to the opening (13). This opening (15) is larger than the shaft hole (14) and than the opening (13) of the seal (11). The shaft (16) of a tension hook (17) penetrates through the shaft hole (14), the opening (13) and the opening (15). Forming a claw (latch member) (18), the shaft (16) is designed as a hook (19). The shaft (16) is furthermore equipped with a surrounding collar (20), the size of which approximately corresponds to opening (15) and which exerts pressure on the seal (11) when in the tension position.

In the center section a bolt (guide member) (21) penetrates the shaft (16). The ends of the bolt (21) protrude on both sides of the shaft (16) and engage in angled slots (22) of the side walls (23) of the locking mechanism. Each angled slot (22) features a slot section (22') that runs transverse to the parting plane of the suitcase bottom (3) and cover lid (5). The second slot section (22") of the angled slot (22) joins the first slot section (22') in an obtuse angle.

The end of the tension hook (17) that faces away from the claw of the hook (18) is designed as a filling piece (24). It engages in an aperture (25) of an actuating lever (26). In the tension position of the tension hook (17) the outer surface (24') is flush with the surface (26') of the actuating lever (26), cf. FIG. 1. The tension hook (17) and the actuating lever (26) are coupled to one another by means of a pin (27). The pin (27) penetrates the filling piece (24) as well as the actuating lever (26). The pin (27) projects over the actuating lever on both sides. The protruding ends engage in linear slots (28) of the sides (23) of the housing of the locking mechanism.

The pin (27) thus acts as pivot point of the actuating lever (26) and also as the coupling point between it and the tension hook (17). As can be seen in the drawing, the linear slots (28) are in a common plane with the slot sections (22') of the angled slots (22). On the other side of the pivot point (pin 27) the actuating lever (26) extends into an arm (29). Due to the aperture (25) the arm features two sections. Each section carries a gudgeon (30) at its end that projects over the lateral edge of the actuating lever (26) and engages in a control curve (31) of the side (23) of the housing of the locking mechanism. The control curve (31) crosses the connecting line between the linear slot (28) and the slot section (22') in such a way that the shorter section of the control curve (31) lies above this line. The control curve (31) is slightly curved and extends roughly in the center area between the linear slot (28) and the angled slot (22) in the side (23) of the housing of the locking mechanism. The design of the control curve (31) is furthermore in a way that the space between the lower section of the control curve (31) and of the front wall (10) of the housing of the locking mechanism is smaller than the space between the front wall (10) and the upper section of the control curve (31).

Close to the point where the shaft (16) contacts the filling piece (24), the shaft features a recess (32) which ends just before the bolt (21). A transverse gudgeon (33) of the shaft (16) projects into the recess (31). The end of a draw spring (34) is placed around the transverse gudgeon (33). The other end of the draw spring (34) engages in a transverse web (35) of the housing (10) of the locking mechanism, with the transverse web (35) located close to the front wall (10). Draw spring (34) and its mountings constitute an over-center mechanism. A force is exerted onto the actuating lever (26) by the draw spring (34) in such a way that it pivots around the pivot point—pin (27)—while the gudgeon (30), equipped with a roller (guide member) (36), at the same time rests against the upper end of the control curve (31) as shown in FIG. 1. The gudgeon (30) is thus above a dead center line (T—T) which runs through the pivot point of the actuating lever (26) and the claw (18) of the tension hook (17), namely on the level of the supporting surface of the claw of the hook (18) at a counterlocking component (37) of the suitcase bottom (3). The counterlocking component (37) is formed by a recess (38) in one of the internal panels (39) of the suitcase bottom (3). When in the tension position the hook (19) engages in the counterlocking component (37) on the other side of the supporting surface. Furthermore the collar (20) is supported by the seal (11). Opening forces that may possibly act on the tension hook (17) cause an increased pivoting of the actuating lever (26) in the direction of the locked position, namely due to the gudgeon (30) having moved beyond the dead center position.

Figure 3:
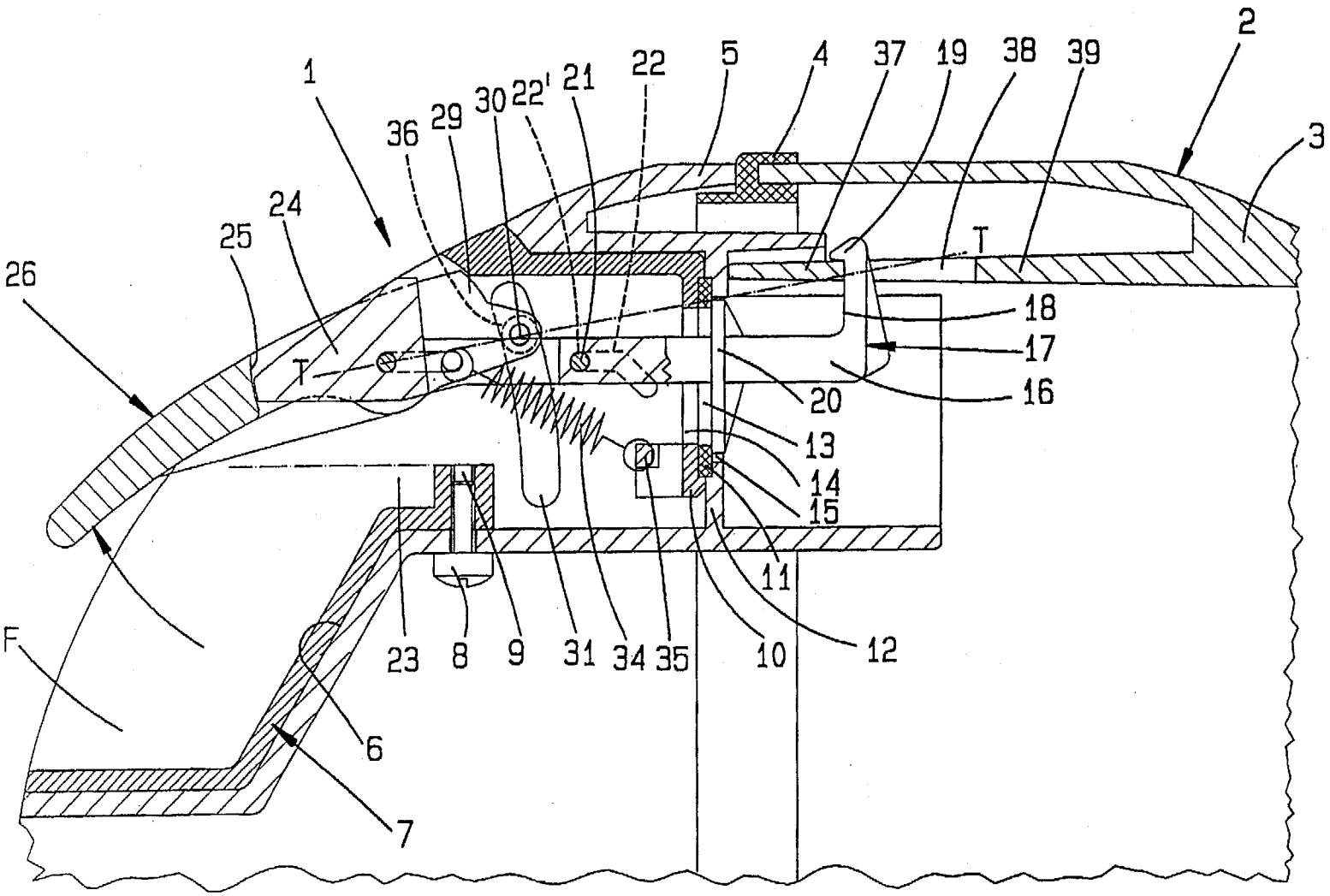
Figure 4:
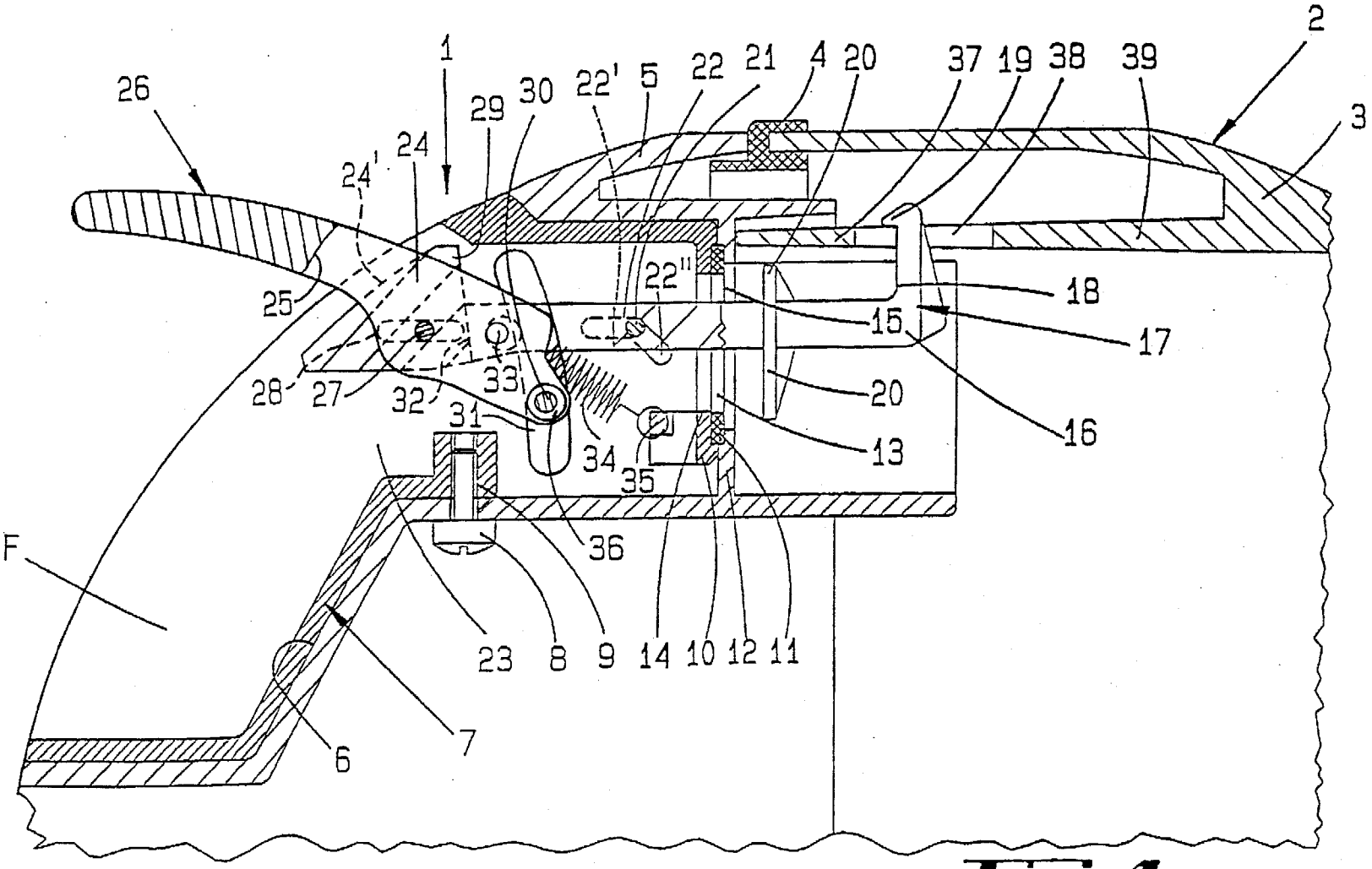
Figure 5:
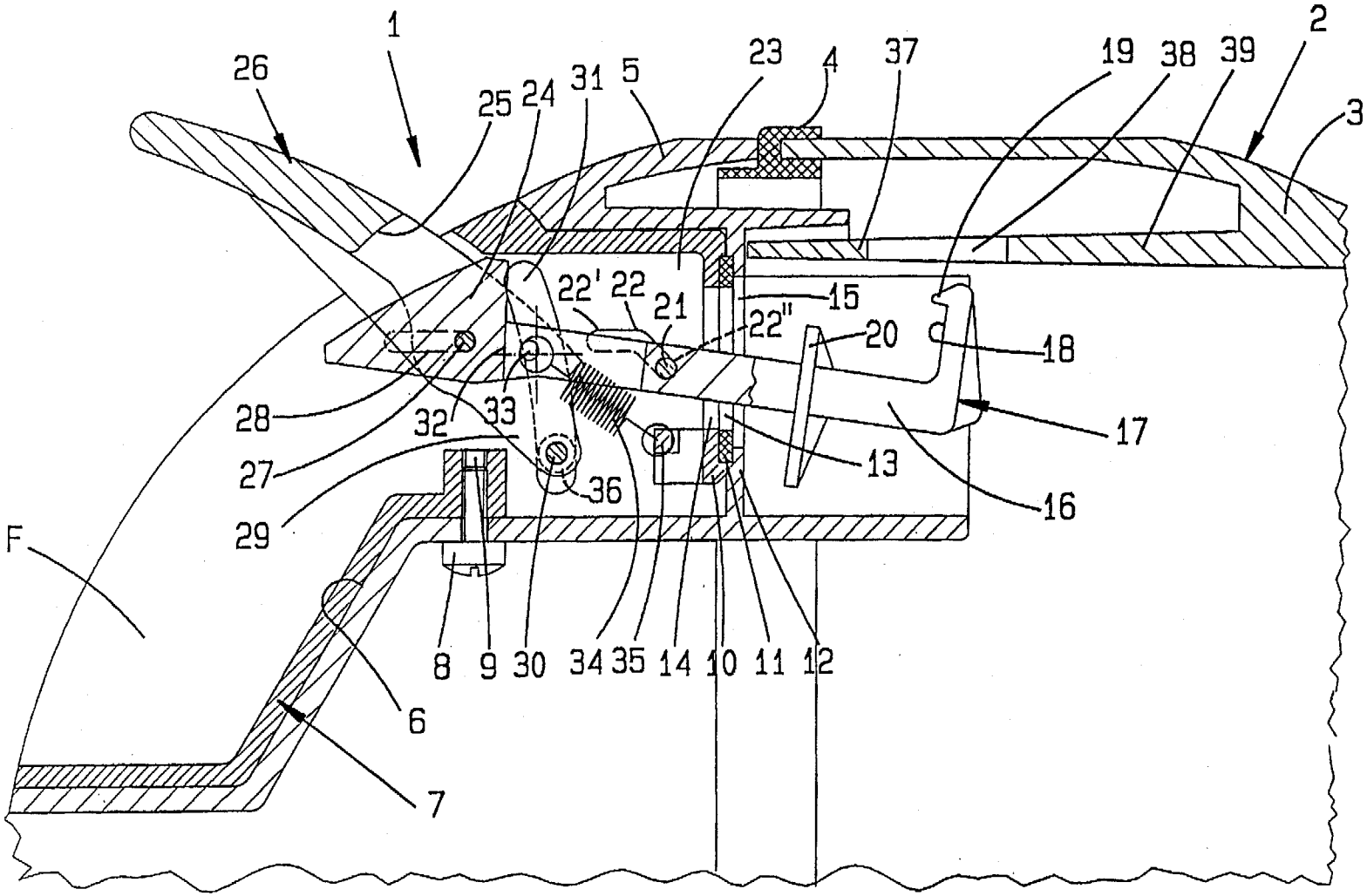
Figure 6:
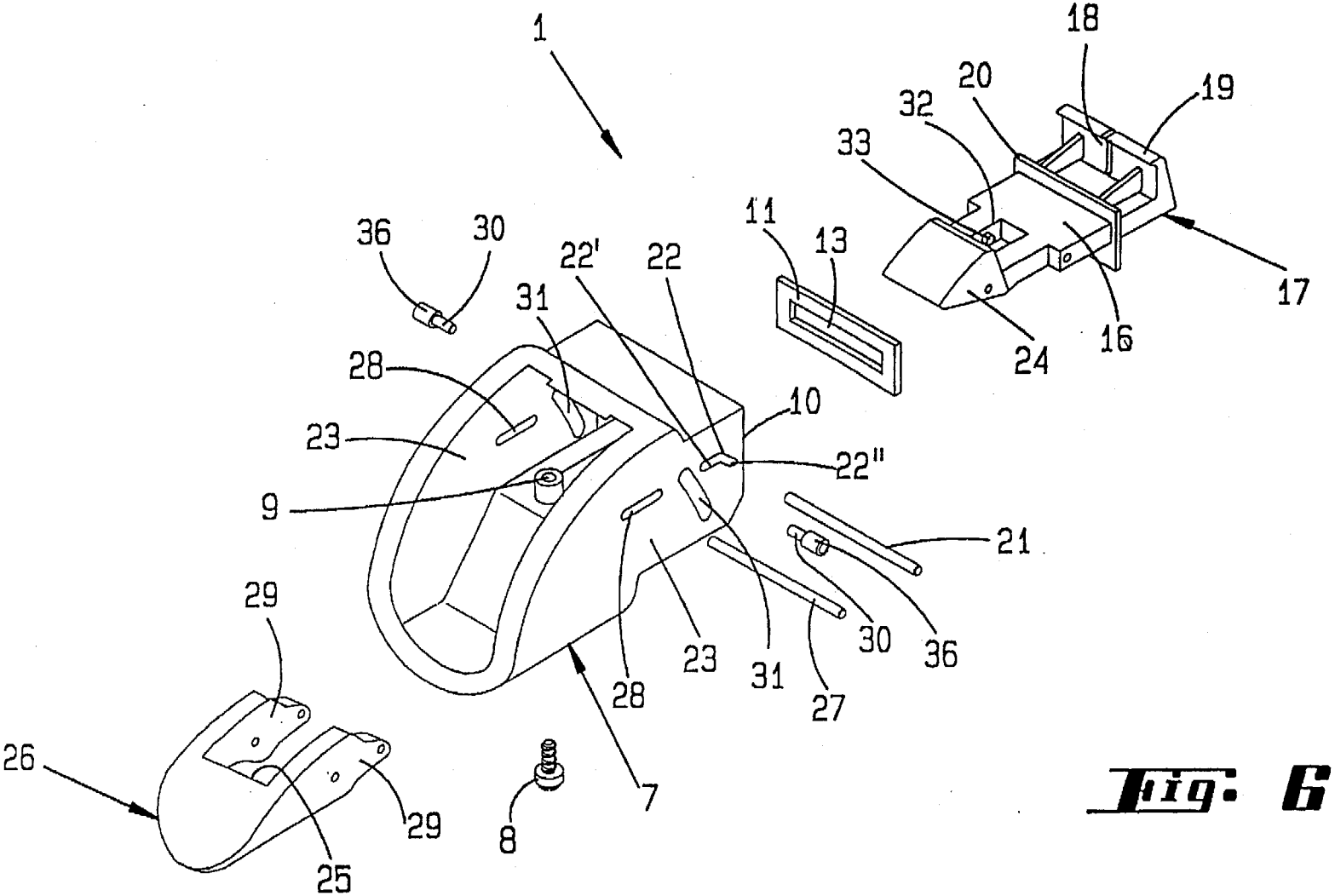

A free space (F) is located between the free end of the actuating lever (26) and the recess (6). The size of this recess (6) is sufficient to allow for the fingers of a human hand to reach beneath the end of the actuating lever (26) and pivot it from its rest position (FIG. 1) around the pivot point (pin 27). FIG. 3 shows an intermediate position of the locking mechanism during the opening motion. The actuating lever (26) is pivoted by such an angle that the gudgeon (30) now lies on the dead center line (T—T). The tension hook (17) is still in its tension position. Furthermore the pivot point (pin 27) is still at the one end of the linear slot (28). The bolt (21) has also not changed its position in the angled slot (22) to where it still rests against the end of the slot section (22'). During the further opening displacement of the actuating lever (26) the position shown in FIG. 4 is reached. The gudgeon (30) of the actuating lever (26) has moved beyond the dead center line to where the draw spring (34) may become effective. It in turn will displace the tension hook (17) in linear direction (longitudinally) with the hook (19) being displaced from an engaged position with respect to the internal panel (39) of the suitcase bottom (3). The pivot point (pin 27) of the actuating lever (26) has shifted within the linear slot (28). The bolt (21) that penetrates the shaft (16) has furthermore entered the angled section (22") of the angled slot (22). If the opening motion is continued the bolt (21) will move further into the angled slot section (22") and at the same time the tension hook (17) will pivot downwards (tilt). See FIG. 5. The pivoting motion is limited by the lower end of the slot section (22"). In this position the pivot point (pin 27) has moved completely through the linear slot (28) and is now at the opposite end of it. Furthermore the actuating lever (26) will be in its open position, with the gudgeon (30) located on arm (29) extending well into the lower section of the control curve (31). The cover lid (5) of the suitcase may now be opened without any restriction.

If the locking mechanism (1) is to be locked, then the cover lid (5) of the suitcase will have to be closed first. The actuating lever (26) will now have to be pivoted in the opposite direction, with an intermediate position as shown in FIG. 4 reached while the draw spring (34) is extended. The hook (19) penetrates through the recess (38) and then lies above the internal panel (39) of the suitcase bottom (3). During the further pivoting motion of the actuating lever the tension hook (17) will move in linear direction until it reaches the position shown in FIG. 3. The pivot point (pin 27) is again at the one end of the linear slot (28) while the gudgeon (30) lies on the level of the dead center line (T—T). The further pivoting motion of the actuating lever (26) in the locking direction is now supported by the force of the draw spring (34), which at the same time ensures that the end position shown in FIG. 1 is reached. Even strong vibrations like the ones encountered during the transport of a suitcase may not move the actuating lever (26) from its locked position.

The contents of German Utility Model Application No. G 94 08 707.5, filed May 27, 1994, are incorporated herein by reference.

We claim:

1. A locking mechanism comprising a housing, a shaft extending in said housing and having a latch member thereon adjacent to one end portion thereof, an actuating lever adjacent to an opposite end portion of said shaft, said shaft and said actuating lever being interconnected for conjoint translational movement of said shaft and said actuating lever and for pivotal movement of said actuating lever relative to said shaft, and a guiding system that guides movement of said shaft and said actuating lever in said housing for causing conjoint translational movement of said shaft and said actuating lever in said housing in response to a predetermined degree of turning of said actuating lever from a rest position relative to said shaft, whereby said latch member moves from a first position to a second position, and for causing said shaft to tilt relative to said housing in response to further turning of said actuating lever, whereby said latch member is turned away from said second position; wherein the interconnection of said actuating lever and said shaft includes a pivot member pivotally connecting said opposite end portion of said shaft to said actuating lever at a point between opposite ends of said actuating lever, and wherein said guiding system guides said pivot member for reciprocation in said housing, guides one end of said actuating lever, adjacent to said shaft, for arcuate movement in said housing transverse to said shaft, and guides said shaft for movement longitudinally of said shaft when said operating lever is turned to said predetermined degree and for movement laterally of said shaft during said further turning of said actuator lever, and wherein said actuating lever has a manually engageable portion for turning said actuator lever.

2. A locking mechanism in accordance with claims 1, further comprising an over-center mechanism including a spring urging said latching member to said first position when said actuating lever is in said rest position and then urging said latching member to said second position and to a third position when said actuating lever has turned to a predetermined position away from said rest position.

3. A locking mechanism in accordance with claim 1, wherein said housing has an opening through which said shaft extends and said shaft carries a member that closes said opening when said latching member is in said first position.

4. A locking mechanism in accordance with claim 1, wherein there is a space between said manually engageable portion and said housing for receiving a user's fingers to turn said actuating lever.

5. A locking mechanism comprising a pivoting actuating lever and a curve-controlled tension hook that pivots and at the same time is shifted longitudinally, characterized by the fact that a pivot point of said actuating lever is also a coupling point of the tension hook and the actuating lever and may be displaced in the direction of the longitudinal shift, that an arm of the actuating lever that extends beyond the pivot point has a gudgeon that runs in a control curve responsible for the longitudinal shift, between opening and tension positions, and moves beyond a dead center line which runs through the pivot point of the actuating lever and a claw of the tension hook, and that an end of the tension hook that is opposite to the claw of the tension hook is designed as a filling piece which penetrates an aperture of the actuating lever until it is flush with its surface.

6. A locking mechanism in accordance with claim 5, characterized by the fact that an angled slot is provided between the control curve and the claw of the tension hook in which a shaft of the tension hook is guided.

7. A locking mechanism in accordance with claim 6, characterized by the fact that the shaft of the tension hook features a collar.

8. A locking mechanism in accordance with claim 7, characterized by the fact that the collar exerts pressure on a seal that encloses a shaft hole while simultaneously closing the shaft hole.

* * * * *